US005666610A

United States Patent [19]

Tanaka et al.

[11] Patent Number: 5,666,610

[45] Date of Patent: Sep. 9, 1997

[54] IMAGE FORMING APPARATUS WITH BLANK EXPOSURE MEANS

[75] Inventors: Makoto Tanaka, Tokyo; Jun Koide, Yokohama, both of Japan

[73] Assignee: Canon Kabushiki Kaisha, Tokyo, Japan

[21] Appl. No.: 203,500

[22] Filed: Feb. 28, 1994

Related U.S. Application Data

[63] Continuation of Ser. No. 921,978, Aug. 4, 1992, abandoned, which is a continuation of Ser. No. 572,302, Aug. 27, 1990, abandoned, which is a continuation of Ser. No. 181,113, Apr. 13, 1988, abandoned.

[30] Foreign Application Priority Data

Apr. 22, 1987 [JP] Japan ..... 62-99541
May 27, 1987 [JP] Japan ..... 62-130922

[51] Int. Cl.[6] ..... G03G 15/04
[52] U.S. Cl. ..... 399/187
[58] Field of Search ..... 355/67, 69, 71, 355/218, 219

[56] References Cited

U.S. PATENT DOCUMENTS

| | | | |
|---|---|---|---|
| 4,087,170 | 5/1978 | Sawaoka et al. | 355/218 X |
| 4,333,130 | 6/1982 | Mochizuki et al. | 355/67 X |
| 4,627,703 | 12/1986 | Suzuki et al. | 355/71 X |
| 4,894,682 | 1/1990 | Kondo et al. | 355/55 |

FOREIGN PATENT DOCUMENTS

| | | |
|---|---|---|
| 54-642 | 6/1979 | Japan . |
| 57-26870 | 2/1982 | Japan . |
| 57-53760 | 3/1982 | Japan . |
| 57-188047 | 11/1982 | Japan . |
| 58-16251 | 1/1983 | Japan . |
| 58-196555 | 11/1983 | Japan . |

*Primary Examiner*—Fred L. Braun
*Attorney, Agent, or Firm*—Fitzpatrick, Cella, Harper & Scinto

[57] ABSTRACT

An image forming apparatus includes a movable photosensitive member, a slit for imagewise exposure of said photosensitive member to light in a slit exposure area having a width in a direction of movement of said photosensitive member, and a movable reflecting member for forming a non-image area on said photosensitive member by light from said reflecting member. When blank exposure is effected, the reflecting member is disposed at a first position or a second position. When the reflecting member is disposed at the first position, the light from the reflecting member is substantially condensed on or adjacent to an upstream end of the exposure area width on the photosensitive member with respect to the movement direction of the photosensitive member, and an area before an image area on the photosensitive member in which an image is formed by the slit exposure means is exposed to the light. When the reflecting member is disposed at the second position, the light from the reflecting member is substantially condensed on or adjacent a downstream end of the exposure area width on the photosensitive member, with respect to the movement direction of the photosensitive member, and an area after the image area is exposed to the light.

4 Claims, 9 Drawing Sheets

IMAGE FORMING APPARATUS WITH BLANK EXPOSURE MEANS

This application is a continuation of application Ser. No. 07/921,978 filed on Aug. 4, 1992, now abandoned, which is a continuation of Ser. No. 07/572,302 filed on Aug. 27, 1990, now abandoned, which is a continuation of Ser. No. 07/181,113, filed on Apr. 13, 1988, now abandoned.

FIELD OF THE INVENTION AND RELATED ART

The present invention relates to an image forming apparatus having blank exposure means.

In the case, for example, where a copy is made from an original having a figure or characters extending to an edge of the original, if an image corresponding to the entirety of the original including the edge portion is formed on a photosensitive member, a leading edge of a transfer material conveyed for receiving the image from the photosensitive member kicks the toner image at the edge portion to scatter the toner particles, with the result that the leading edge portion of the transfer material is contaminated and that the inside of the copying apparatus is contaminated. Also, where the copying apparatus includes a roller type image fixing device wherein the transfer material is passed through a nip formed between rollers, the transfer material tends to be easily wrapped around the roller, which may be a cause of paper jam, if the image is formed at a leading end of the transfer material.

Usually, an original is placed on an original supporting platen with its one edge registered with an index on the platen. However, it is often that the copying operation is performed with the edge not correctly registered with the index, in which case the clearance between the edge of the original and the index member is reproduced as a black original. This aggravates the above described inconveniences, in addition to the degrading of the quality of the image by the black stripe formed at a leading edge of the transfer material.

Proposals have been made in order to avoid the inconveniences, wherein a small width white paper is attached or white paint is applied to a bottom surface of the original supporting platen at a position where the edge of the original is to be placed, as disclosed in Japanese Laid-Open Patent Application 87845/1973 and 642/1979, for example. However, in this method, a shade is formed on an original outside the white stripe area when the original is illuminated, and the shade is reproduced on the copy, and therefore, the degrading of the image quality is not solved.

As another proposal, a blank exposure is known, as disclosed in Japanese Laid-Open Patent Application No. 26870/1982, wherein uniform light is applied to non-image areas, i.e. the areas before and after the image area where the image is to be formed, so that the electric charge in the non-image areas is dissipated or attenuated to prevent the developer from being deposited in the non-image areas. Japanese Laid-Open Patent Application No. 53760/1982 under the name of the assignee of this invention discloses that a blank portion is formed adjacent a leading edge of the copy using the blank exposure means, and it is embodied in a commercial electrophotographic machine, Canon NP-120.

As shown in FIGS. 1 and 2, the known blank exposure means comprises a lamp (light source) 101 and a concave reflecting member 102 for condensing the light from the lamp 101 on a rotatable photosensitive member 100. When the photosensitive member is exposed to image light through a slit in the image area, the reflecting member 102 is retracted to a chain line position outside the slit exposure optical path L to allow imagewise exposure. When, on the other hand, the non image area of the photosensitive member is blank-exposed, the reflecting member 102 is returned to the solid line position across the slit exposure optical path L to block the image exposure light, while directing and condensing the light from the lamp 101 on the photosensitive member.

When a predetermined circumferential length of the surface of the photosensitive member corresponding to the predetermined length of a leading edge portion of an original is blank-exposed by the reflecting member 102 maintained at the solid line position, a position c on the photosensitive member where the image exposure is to start reaches a position shown in FIG. 1, that is, to an end of the image exposure area. At this instance, the reflecting member 102 is retracted to the chain line position to allow the image exposure by the slit exposure light L to be started. When a trailing edge d of the image area on the photosensitive member reaches a position shown in FIG. 2, the reflecting member 102 is returned to the solid line position to blank-expose the photosensitive member again. By this, it is possible to form a blank portion adjacent a leading edge portion of the transfer material within a predetermined length.

In this apparatus, however, it has been found that the problem is not satisfactorily solved, since a black stripe in a half-tone is formed in the leading edge black portion, by which the image quality is degraded. Also, when the image is transferred onto a transfer material having a size larger than the size of the image formed on the photosensitive member, the half-tone stripe is formed on the trailing edge portion of the transfer material.

SUMMARY OF THE INVENTION

Accordingly, it is a principal object of the present invention to provide an image forming apparatus comprising an improved blank exposure means.

It is another object of the present invention to provide an image forming apparatus comprising a blank exposure means which is effective to prevent production of a half-tone black stripe adjacent a leading edge portion of an image area within a non-image area.

It is a further object of the present invention to provide an image forming apparatus having a blank exposure means which is effective to prevent production of a half-tone black stripe adjacent a trailing edge portion of an image area within a non-image area.

It is a yet further object of the present invention to provide an image forming apparatus having a blank exposure means which is effective to prevent production of half-tone black stripes adjacent leading and trailing edge portions adjacent an image area within a non-image area.

It is a still further object of the present invention to provide an image forming apparatus having a blank exposure means which is effective to prevent production of half-tone black stripes in leading edge and/or trailing edge blank portions of a transfer material.

The causes of the above-discussed problems are considered as follows. In the known apparatus shown in FIG. 1, the condensing point where the light from the lamp 102 is condensed on the photosensitive member by the reflecting member 102 is located adjacent a center in the slit exposure area L in which the photosensitive member is exposed to the image light (a-c area in FIG. 1, or d-f area in FIG. 2), as shown in FIGS. 1 and 2, and therefore, the blank exposure is not sufficient in the area on the photosensitive member between the condensing point b and the position c in FIG. 1, and the area between the condensing point e and the position d in FIG. 2. This reduces a time-integrated exposure amount on the photosensitive member in those areas becomes smaller as shown by references g and h in FIG. 3. Therefore, the areas corresponding to the positions g and h on the photosensitive member are not electrically discharged to a sufficient extent with the result that the developer is deposited in half-tone. Because of this, a black stripe in the half-tone is formed in the leading edge blank portion of the transfer material conveyed to align with a position between positions a and b. This degrades the quality of the image.

When the image is transferred onto a transfer material having a size larger than the size of the image formed on the photosensitive member, the half-tone black stripe is formed in a trailing edge portion of the transfer material which corresponds to the position b. This also degrades the image quality. Those are problems even in an image forming apparatus wherein no blank portion is formed in the leading edge portion and the trailing edge portion, that is, in the image forming apparatus wherein an image is transferred onto the transfer material which has substantially the same size as the image formed on the photosensitive member, because the deposition of the developer in the areas on the photosensitive member corresponding to the positions a and b wastes the developer, and because the developer can contaminate the transfer means or the like.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 4:
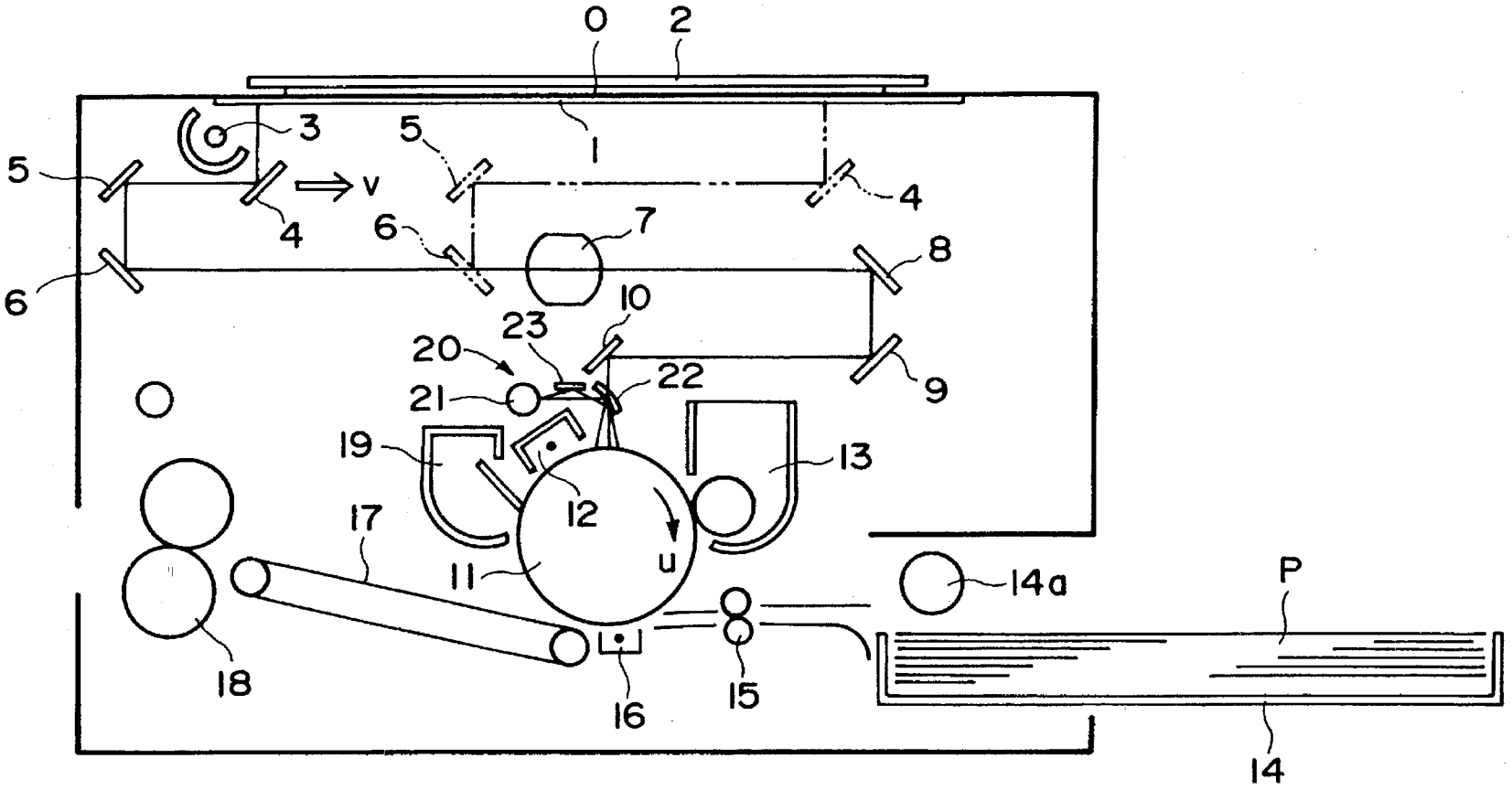
FIG. 4 is a sectional view of an electro-photographic copying apparatus according to an embodiment of the present invention.

Referring to FIG. 4, there is shown an electrophotographic copying machine as an exemplary image forming apparatus according to an embodiment of the present invention, which comprises an original supporting platen 1, on which an original O is placed face down at a predetermined position. The original O is pressed by an original pressing plate 2.

Below the original supporting platen 1, there is disposed a known slit exposure optical system which comprises an original illuminating lamp 3, movable mirrors 4, 5 and 6, an imaging lens 7 and fixed mirrors 8, 9 and 10. The lamp 3 and the mirror 4 are moved at a predetermined speed V in the direction indicated by an arrow, and the mirrors 5 and 6 are moved in the same direction at one half speed to scan the original, and the light image is applied onto the photosensitive member 11 in the form of a drum through the lens 7 and the mirrors 8 and 9 through a slit. Thus, the photosensitive member 11 is exposed to the light image of the original within a slit exposure area having a small width in the direction of the movement of the photosensitive member 11 and which is long in the substantially perpendicular direction, that is, the direction substantially parallel to a rotational axis of the photosensitive member 11.

The photosensitive member 11 rotates at a predetermined peripheral speed in a direction u. During the rotation, the photosensitive member 11 is uniformly charged by a corona discharger 12, and the charged surface thereof is exposed to the image light by the slit exposure optical system, so that an electrostatic latent image is formed corresponding to the original image. The electrostatic latent image is visualized into a toner image by a developing device 13 which applies a developer to the photosensitive member 11.

On the other hand, a transfer material P singled out of a sheet cassette by a pick-up roller 14*a*, is timed by a registration roller 15 with rotation of the photosensitive member 11 and is advanced into the space between the photosensitive member 11 and a transfer corona charger 16. The transfer charger 16 transfers the toner image from the photosensitive member 11 onto the transfer material P. In place of the transfer charger 16, a transfer roller press-contacted to and rotatable with the photosensitive member 11 is usable.

Then, the transfer material P having received the toner image is separated from the surface of the photosensitive member and is conveyed by a conveying belt 17 into an image fixing device 18, where the toner image thereof is fixed. Thereafter, the transfer sheet is discharged outside the image forming apparatus as a copy. On the other hand, the surface of the photosensitive member 11 from which a toner image has been transferred onto the transfer material P is cleaned by a cleaning device 19 so that a residual toner or the like is removed, and the photosensitive member 11 is prepared for the next image formation.

A blank exposure means 20 for illuminating non-image areas on the photosensitive member 11 is disposed in the structure described above adjacent the slit exposure optical path between the fixed mirror 10 and the photosensitive member 11.

Figure 6:
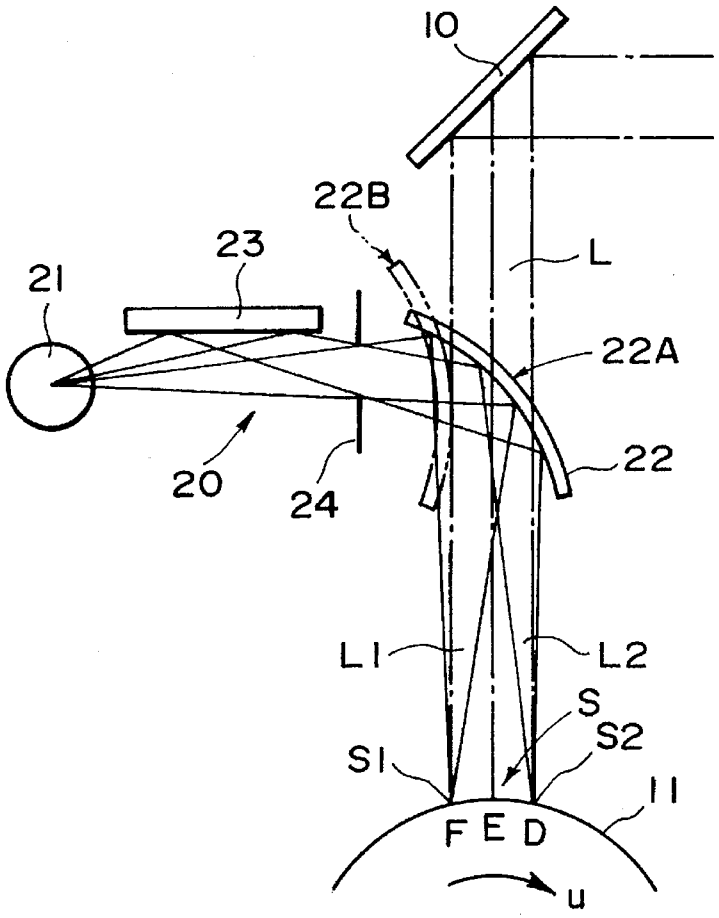
FIGS. 5 and 6 are enlarged illustrations of the blank exposure means provided in FIG. 4 apparatus.
Figure 5:
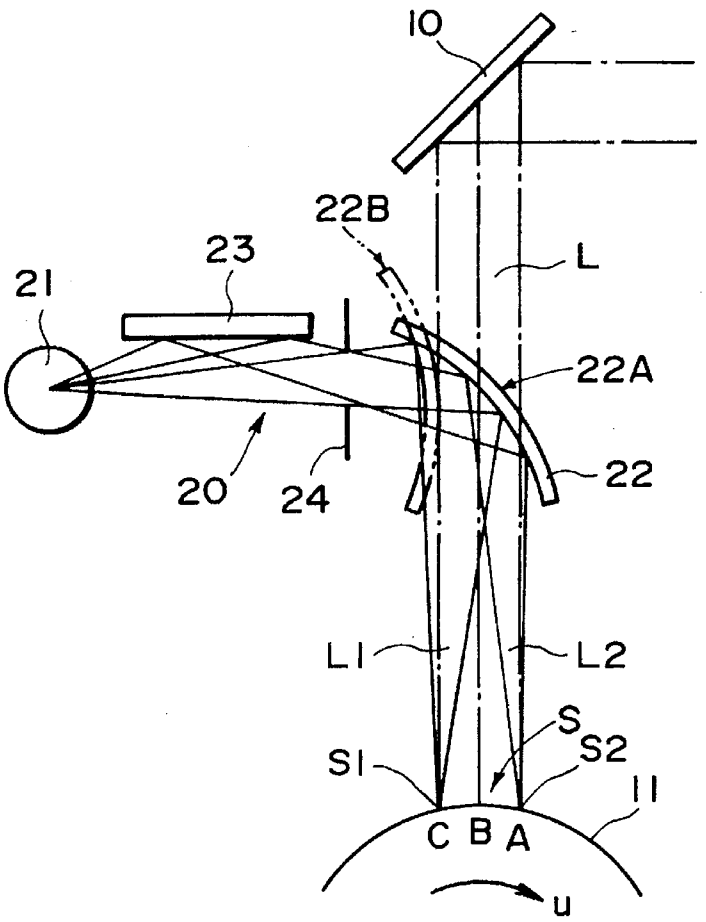

As shown in FIGS. 5 and 6, the blank exposure means 20 comprises a lamp 21, a movable and curved (concave) reflecting member 22 and a fixed reflecting member 23 having a flat reflecting surface. A part of the light from the lamp 21 is directly incident on the curved reflecting member 22 which functions as a condensing means, namely the light rays L1 reflected by the curved reflecting member 22 are condensed at or adjacent an edge S1 of the slit exposure area S in which the photosensitive member is exposed to the image light of the original through the slit by light rays L. The light rays L2 which are from the lamp 21 and are incident on the flat reflecting member 23 and then reflected by the curved reflecting member 22, are condensed at or adjacent the other edge S2 of the slit exposure area S. The edges S1 and S2 are opposite in the direction of the movement of the photosensitive member 11, and the edge S2 is downstream of the edge S1 with respect to the peripheral movement of the photosensitive member. The edges S1 and S2 are extended in the direction perpendicular to the movement direction of the photosensitive member 11, that is, in the direction substantially parallel to the rotational axis of the photosensitive member 11. A light blocking member 24 is provided with a window through which the light is passed.

The curved reflecting member 22 is rotatable by an unshown driving mechanism comprising an electromagnetic plunger and a spring, and it takes a position shown by solid lines in FIGS. 5 and 6 by a reference 22A during blank exposure to be disposed across an original image exposure optical path between the fixed mirror 10 of the slit exposure optical system and the photosensitive member 11, so as to prevent the photosensitive member 11 from being exposed to the slit exposure light rays L, while to project and condense the light rays L1 and L2 from the lamp 21 on the photosensitive member 11. On the other hand, upon the original image exposure, the curved reflecting mirror 22 is retracted outside the image exposure optical path as shown by a reference 22B in FIGS. 5 and 6 so as to allow the image exposure of the photosensitive member 11, while to prevent the light rays from the lamp 21 from being projected on the photosensitive member 11.

In the state shown in FIG. 5, in order to form a blank portion of a predetermined width of a leading edge portion of the transfer material P, the photosensitive member is blank-exposed in the area corresponding to the predetermined width of the original. The curved reflecting member 22 takes the solid line position 22A to sequentially blank-expose the photosensitive member 11 with the rotation thereof by the condensed light rays L1 and L2 from the lamp 21 to the photosensitive member 11. When the blank-exposure of the photosensitive member in the area corresponding to the predetermined area of the leading edge portion of the original is completed, that is, when the leading edge C of the image area where the latent image is to be formed comes to a first edge S1 of the slit exposure area S, as shown in FIG. 5, the curved reflecting member 22 is retracted to the chain line position 22B in FIG. 5, by which the light rays from the lamp 21 is prevented from reaching the photosensitive member 11. By this time, that portion of the photosensitive member surface which is from the position C to the condensing position A of the light rays L2 in FIG. 5 has been blank exposed by the condensing light rays L1, and that portion of the photosensitive member surface which is downstream of the position A with respect to movement direction of the photosensitive member 11 has been blank-exposed by the light rays L1 and L2.

By the retraction of the curved reflecting member 22 to the chain line position 22B, the image exposure optical path is opened, so that the slit exposure light rays L is projected onto the photosensitive member 11 in the slit exposure area S, by which an electrostatic latent image is sequentially formed on the photosensitive member surface in the area upstream of the position C on the photosensitive member 11.

When the latent image formation is completed, that is, when a trailing edge D of the image area on the photosensitive member 11 reaches a second edge S2 of the slit exposure area S, as shown in FIG. 6, the curved reflecting member 22 returns to the solid line position 22A, by which the blank exposure begins again. After the blank exposure resumes, the area on the photosensitive member surface from the position D to the condensing position F of the condensing light rays L1 in FIG. 6 is blank-exposed to the condensing light rays L2, and the area upstream of the position F with respect to the movement direction of the photosensitive member is blank-exposed by the condensing light rays L1 and L2.

Figure 2:
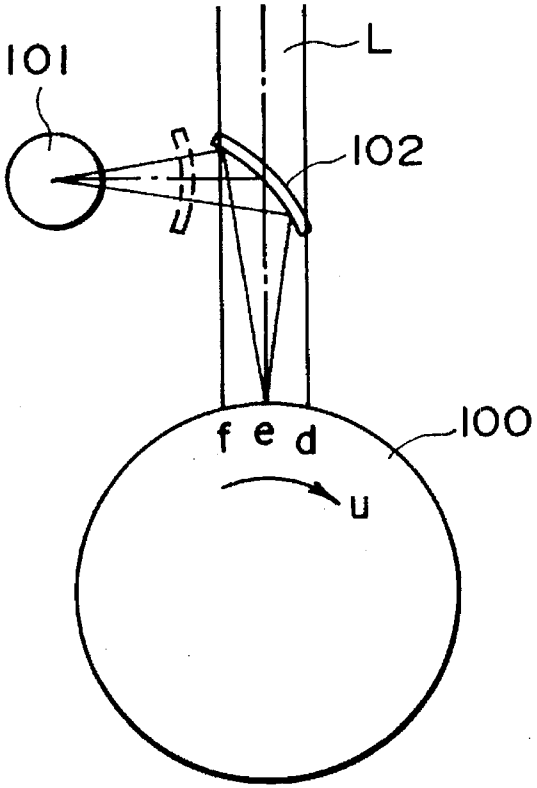
FIG. 2 PRIOR ART
FIGS. 1 and 2 are schematic sectional views illustrating conventional blank exposure means.
Figure 1:
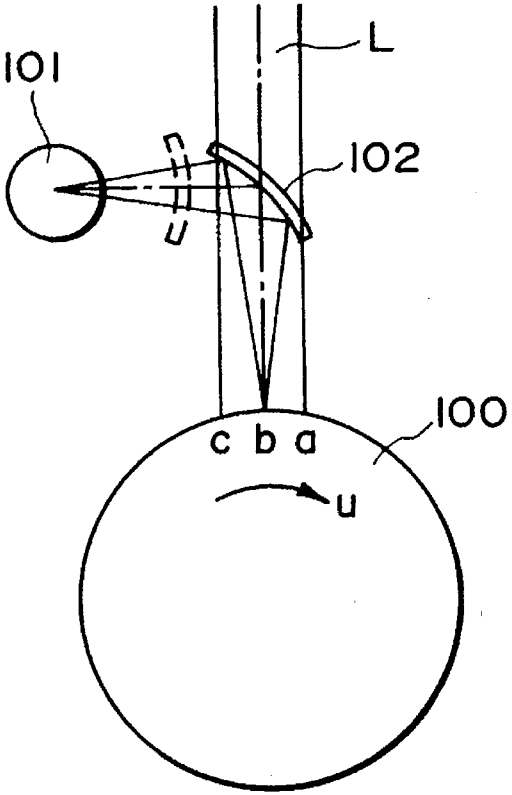
FIG. 1 PRIOR ART
Figure 3:
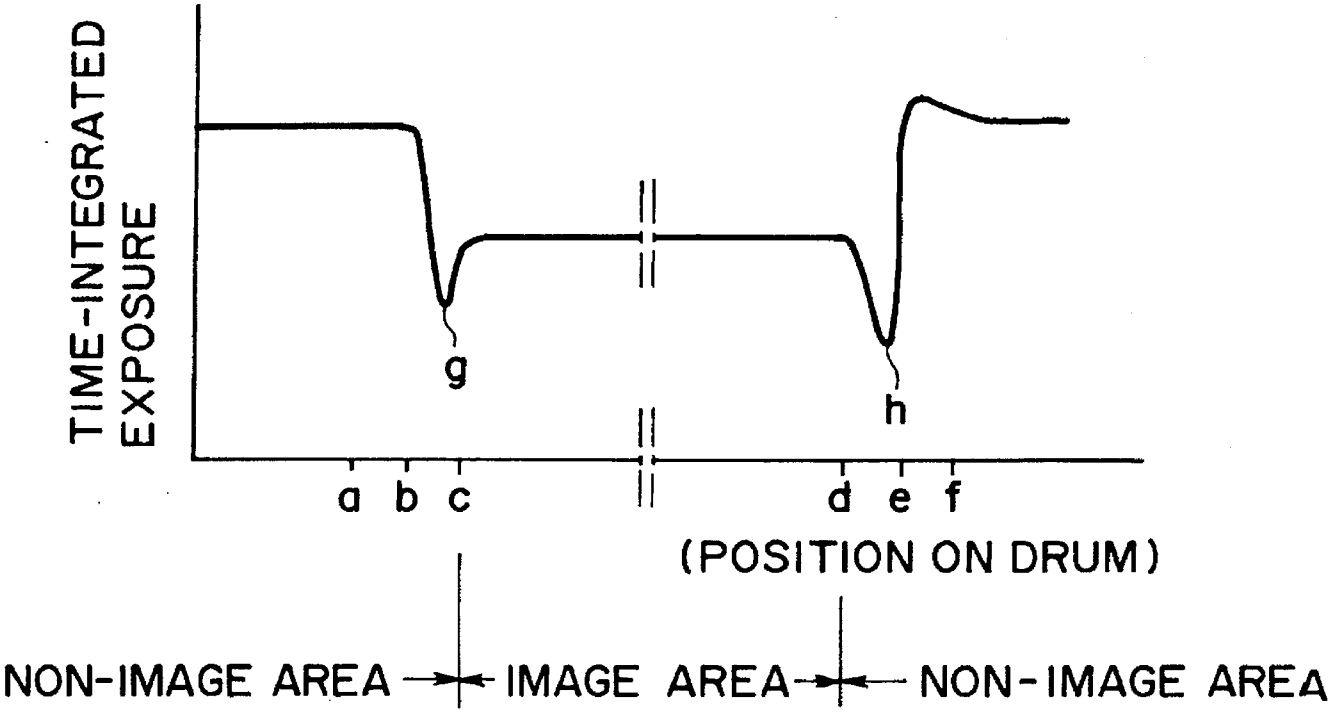
FIG. 3 PRIOR ART
FIG. 3 is a graph of light exposure distribution on a surface of a photosensitive member in the conventional blank exposure means.
Figure 7:
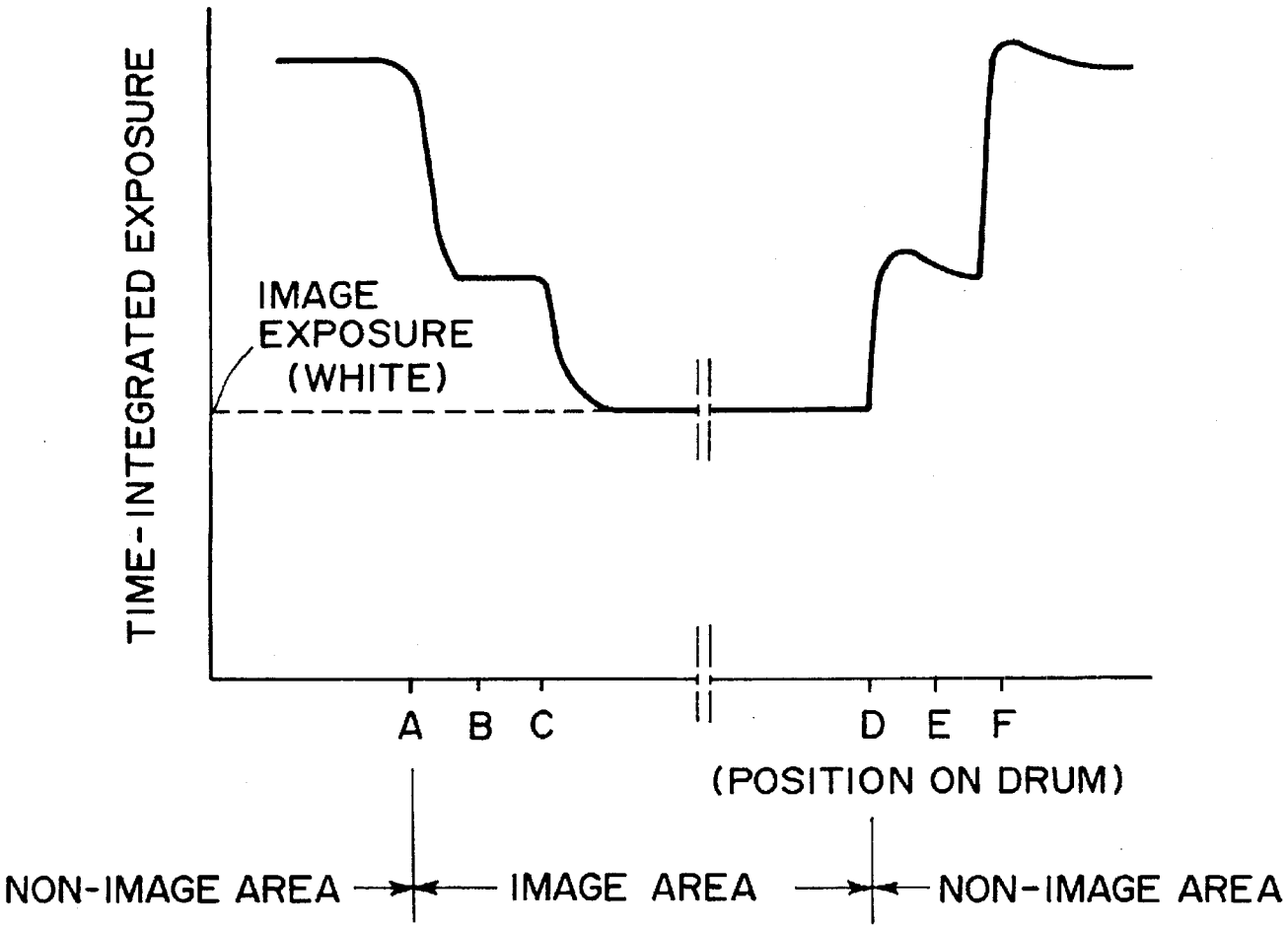
FIG. 7 is a graph of light exposure distribution on the surface of the photosensitive member provided by the blank exposure means illustrated in FIGS. 5 and 6.

FIG. 7 is a graph of a time-integrated exposure amount of the photosensitive member against positions on the photosensitive member by the above-described process. As will be understood from FIG. 7, the shortage of the exposure as indicated by references g or h in FIG. 3 is eliminated. Accordingly, the half-tone black stripe experienced by the conventional art is prevented.

Figure 8:
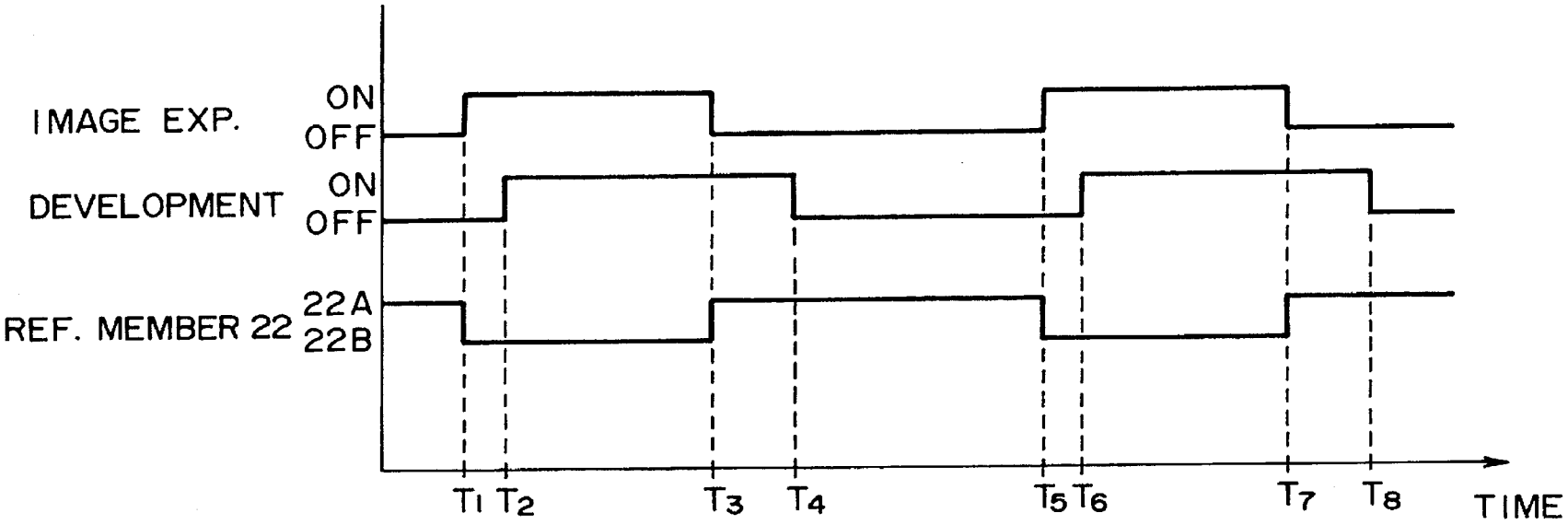
FIG. 8 is a timing chart of the blank exposure means illustrated in FIGS. 5 and 6.

FIG. 8 is a timing chart of the operation when plural copies are produced. In this Figure, the developing device 13 is indicated as starting its operation a little before the position C of the photosensitive member reaches a developing station and to terminate its operation a little after the position D on the photosensitive member 11 passes through the developing station. However, the developing device 13 may be maintained operated during the rotation of the photosensitive member 11.

The registration roller 15 advances the transfer material P to the image transfer station so that the predetermined leading edge portion of the transfer material P is aligned in the transfer station with the area between the positions A and C of the photosensitive member 11 shown in FIG. 5 (the area is exposed to the light rays L1 immediately before the points of time T1 and T5 of FIG. 8). By this, a blank portion having a predetermined width or length is formed in the leading edge portion of the transfer material P.

When, on the other hand, the image is transferred from the photosensitive member 11 onto a transfer material having a size larger than that of the image on the photosensitive member 11, the trailing edge of the transfer material P conveyed to the transfer station by the registration roller 15 is aligned in the transfer station with a portion of the photosensitive member which is blank-exposed during the period from time T3 to time T5, whereby a blank portion is formed in the trailing edge area of the transfer material P.

In an apparatus wherein the image is transferred from the photosensitive member 11 to a transfer material P having the same size as the image on the photosensitive member 11, the registration roller 15 advances the transfer material P into the transfer station such that the leading edge of the transfer material P is aligned in the transfer station with the position C of the photosensitive member 11 shown in FIG. 5, and that the trailing edge of the transfer material P is aligned in the transfer station with the position D of the photosensitive member 11 shown in FIG. 6. In this case, the original O is projected onto the photosensitive member 11 from its leading edge without blockage. The reflecting member 22 is retracted to the position 22B substantially simultaneously with the mirror 4 starting to scan the leading edge of the original O. On the other hand, in the apparatus wherein a blank portion is formed at the leading edge portion of the transfer material P, the reflecting member 22 is retracted to the position 22B with time delay from the point of time at which the mirror 4 starts to scan the leading edge of the original O by a time period corresponding to the width of the blank portion, so that the image formation light rays L is blocked, correspondingly to the predetermined width of the original leading portion, during the time period before the retraction of the reflecting member 22.

In the foregoing embodiment, the curved reflecting member 22 constituting the blank exposure means 20 has been explained as being rotatable, but this is not limiting, and it may be translatable.

Also, in the foregoing embodiment, two light rays L1 and L2 are provided by a single light source 21 and two reflecting members 22 and 23. However, the numbers and arrangements of the light sources and reflecting members may be modified property by one skilled in the art, if the light ray condensing positions are formed at or adjacent upstream and downstream edges of the slit image exposure area on the photosensitive member 11.

As another alternative, referring to FIGS. 5 and 6, the position of the lamp 21 is displaced upwardly, and the fixed reflecting member 23 is displaced downwardly, wherein the reflecting surface thereof faces up. Then, the light rays reflected by the reflecting member 23 and then reflected by the reflecting member 22 are condensed at or adjacent the position S1, whereas the light rays directly incident on the reflecting member 22 from the lamp 21 are condensed at or adjacent the position S2.

Furthermore, if it is only required to prevent the production of the half tone black stripe in front of the image area, the reflecting member 23 may be omitted from FIGS. 5 and 6 arrangement, so that the photosensitive member 11 is blank-exposed to the light rays L1 only without the light rays L2. On the contrary, if it is only required to prevent the production of the half tone black stripe at the back of the image area, a light blocking plate for blocking the light rays L1 only at a position, for example, between the lamp 21 and the slit plate 24 in FIGS. 5 and 6, by which the photosensitive member 11 is blank-exposed only by the light rays L2.

Figure 10:
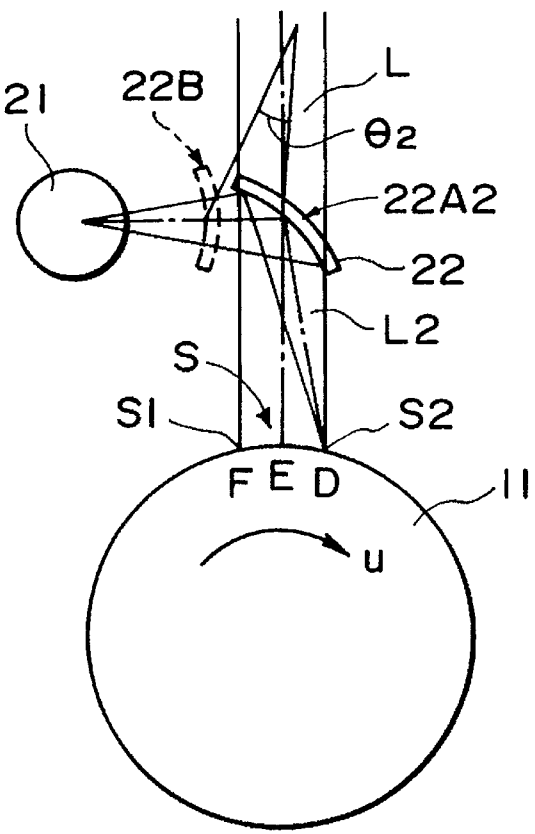
FIGS. 9 and 10 are sectional views illustrating blank exposure means according to another embodiment of the present invention.
Figure 9:
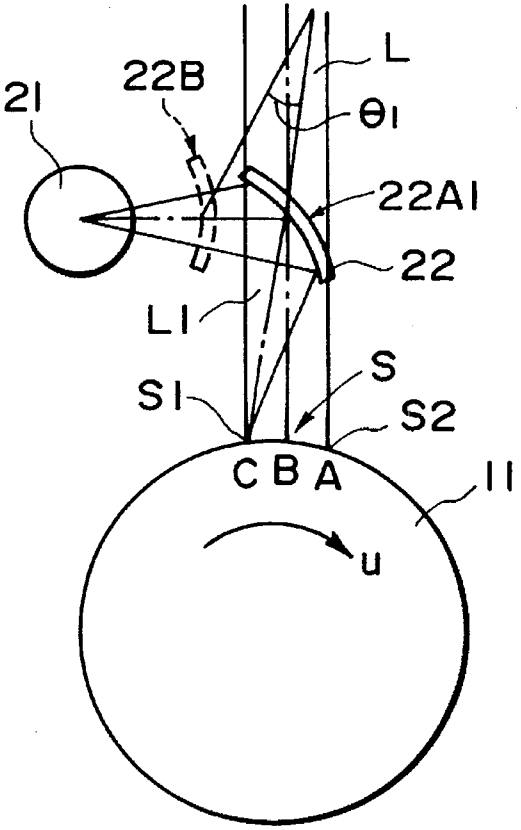

Referring to FIGS. 9 and 10, another embodiment of the present invention will be described, in which a reflecting member 22 takes a first position shown in FIG. 9 in the optical path for the imagewise slit exposure light rays L and a second position shown in FIG. 10. The fixed flat reflecting member 23 of FIG. 4 embodiment is not used in this embodiment.

In FIG. 9, there is shown a position of the concave mirror 22 and the light condensing position of the blank exposure light rays L1 when a blank portion is to be formed at the leading edge portion of a copy. Prior to the photosensitive member 11 being exposed to an image of an original, the concave mirror 22 takes a solid line position 22A1 to prevent the slit exposure light rays L from being incident on the photosensitive member 11, while to project and condense the light rays emitting from the light source 21 at or adjacent the first edge S1 of the slit exposure area S. At this time, the concave mirror 22 takes the position 22A1 which is angle θ1 away from the position 22B.

Substantially simultaneously with the leading edge C of that area on the photosensitive member 11 on which the image is to be formed reaching the position S1, the concave mirror 22 is retracted to the position 22B outside the optical path for the light rays L. By this, the light image of the original is projected onto the photosensitive member 11 subsequently to the blank portion on the photosensitive member 11 (non-image area). The light image is formed into a toner image in the manner described above, and the toner image is transferred onto a transfer material P.

Upon completion of the projection of the light image at the trailing edge of the original onto the photosensitive member 11, the concave mirror 22 is displaced from the broken line position 22B in FIG. 10 to a solid line position 22A2 in the same Figure, so that the image exposure light rays L are prevented from being incident on the photosensitive member 11, whereas the light rays emitting from the light source 21 are projected and condensed at or adjacent a second edge S2 of the slit exposure area S, more particularly, at position D which is adjacent the trailing edge of an image of the original. In this way, the second blank portion is formed subsequently to the image of the original. At this time, the concave mirror 22 is maintained at a second position 22A2 which is different from the first position shown in FIG. 9. In the second position, the concave mirror 22 is away from the position 22D by an angle θ2.

Figure 11:
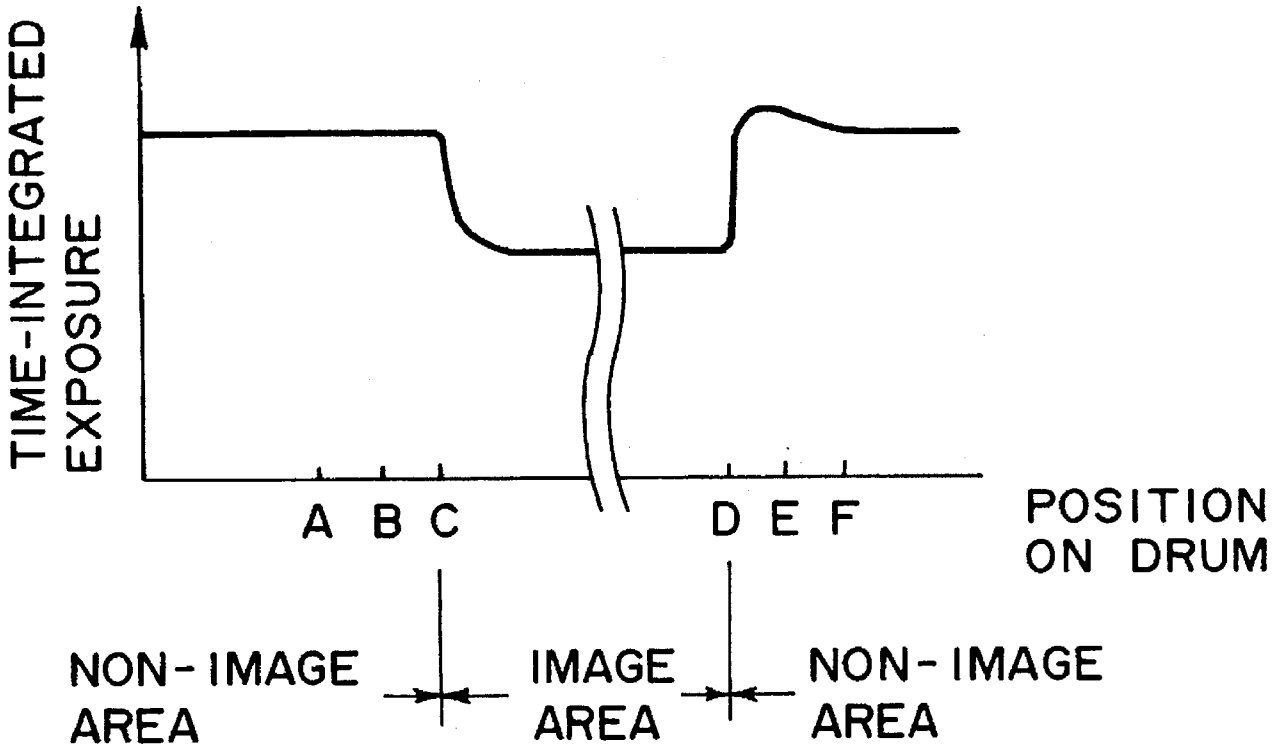
FIG. 11 is a graph of an exposure amount distribution on the surface of the photosensitive member provided by the blank exposure means illustrated in FIGS. 9 and 10.

FIG. 11 is a graph showing a distribution of an integrated amount of exposure of the surface of the photosensitive member 11. As will be understood from this Figure, the shortage of exposure indicated by references g and h in the prior art device shown in FIG. 3, is eliminated, whereby the production of the black stripe can be avoided adjacent leading and trailing edges of the image area within the non-image area.

Figure 12:
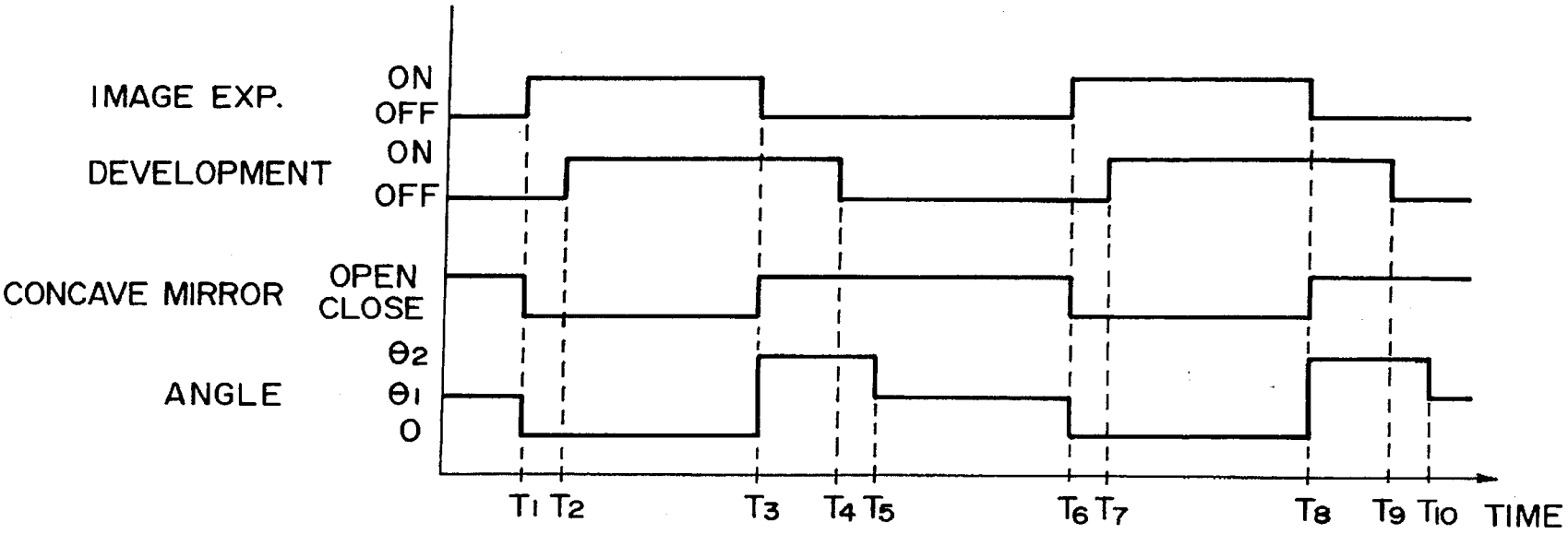
FIG. 12 timing chart of the blank exposure means illustrated in FIGS. 9 and 10.

FIG. 12 is a timing chart illustrating operation of various parts of the image forming apparatus comprising the concave mirror 22 operable in the manner described in conjunction with FIGS. 9 and 10. In FIG. 12, the topmost line indicates the operation of image exposure of the original; the second line indicates the operation of the developing device; the third line indicates the operation of the concave mirror 22, wherein "open" means the position for allowing blank exposure, and "close" means the position outside the optical path for the light rays L; and the bottommost line indicates the change of the angle of the concave mirror 22.

In FIG.12, the concave mirror 22A is displaced from the solid line position 22A1 to the broken line position 22B in FIG. 9 at the points of time T1 and T6, and it is displaced from the broken line position 22B to the solid line position 22A2 in FIG. 10 at the points of time T3 and T8. In addition, it is returned from the solid line position 22A2 in FIG. 10 to the solid line position in FIG. 9 at the points of time T5 and T10. Similarly to FIGS. 5 and 6 embodiment, the developing device 13 is indicated as starting its operation a little before the position C of the photosensitive member 11 reaches the developing station and as terminating its operation a little after the position D of the photosensitive member passes through the developing station. However, the developing device 13 may be maintained operated during the rotation of the photosensitive member 11.

The registration roller 15 advances the transfer material P to the image transfer station such that the leading edge portion of the transfer material P which has the predetermined width is aligned in the transfer station with the area between the positions A and C of the photosensitive member 11 in FIG. 9. By this, a blank portion having a predetermined width is formed in the leading edge portion of the transfer material P.

On the other hand, when the image is transferred from the photosensitive member 11 to a transfer material having a size larger than that of the image on the photosensitive member 11, the trailing edge of the transfer material conveyed to the transfer station by the registration roller 15 is aligned in the transfer station with the portion of the photosensitive member which is blank-exposed from the point of time T3 to the point of time T6 in FIG. 12, by which a blank portion is formed in the trailing edge portion of the transfer material P.

In the apparatus wherein the image is transferred onto the transfer material P having the same size as the image on the photosensitive member 11, the registration roller 15 advances the transfer material P into the transfer station such that the leading edge of the transfer material P is aligned in the transfer station with the position C of the photosensitive member 11 shown i FIG. 9, and that the trailing edge of the transfer material P is aligned in the transfer station with the position D of the photosensitive member 11 shown in FIG. 10. In this case, the light image of the original O is projected onto the photosensitive member 11 without blockage from its leading edge. In other words, the concave mirror 22 is retracted to the position 22B substantially simultaneously with the mirror 4 starting to scan the leading edge of the original O. On the contrary, in an apparatus wherein the blank portion is formed in the leading edge portion of the transfer material P, the concave mirror 22 is retracted to the position 22B with a delay of time corresponding to the width of the blank portion from the point of time at which the mirror 4 starts to scan the leading edge of the original O, and the image light rays L are prevented from being incident on the photosensitive member 11, corresponding to the predetermined width of the leading edge portion of the original, during the time before the retraction.

In this embodiment, if it is only required to prevent production of the half-tone black stripe in the area before the image area, the concave mirror or the reflecting member 22 is movable only between the position 22B and the position 22A1 in FIG. 9. If, on the contrary, it is only required to prevent the production of the half-tone black stripe in the area after the image area, the reflecting member 22 is moved only between the position 22B and the position 22A2 in FIG. 10.

In the foregoing example, the reflecting member 22 has been described as having a concave reflecting surface, but it may be constituted by a plurality of small flat reflecting surfaces arranged in the form of a polygon.

The present invention is applicable to a variable magnification copying apparatus containing a zoom lens which is displaceable, as a lens 7, and another variable magnification copying apparatus wherein the lens 7 is a fixed focus lens, and wherein the image magnification is changed by displacing the mirrors 8 and 9 and the lens 7. In variable magnification copying machines, it occurs quite often that the size of the image to be transferred is smaller than the size of the transfer material onto which the image is to be transferred. In such a case, a blank is provided in the trailing portion of the transfer material, and therefore, it is preferable to blank-expose the photosensitive member by the above-described light rays L2, since then the half tone black stripe is not formed in the blank of the transfer material.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable photosensitive member;

slit exposure means for imagewise exposure of said photosensitive member;

blank exposure means having reflecting member for forming a non-image area before and after an image area formed by said slit exposure means on said photosensitive member by light from said reflecting member;

wherein the light from said reflecting member is condensed on a slit exposure area having a width in a direction of movement of said photosensitive member, and during a blank exposure operation by said blank exposure means, said reflecting member is fixed at a predetermined one position; and wherein the light from said reflecting member is substantially condensed simultaneously both on an upstream end of the slit exposure area and on a downstream end of the slit exposure area with respect to the movement direction of said photosensitive member.

2. An apparatus according to claim 1, wherein said blank exposure means further comprises a second reflecting member disposed upstream of said reflecting member in an optical path.

3. An apparatus according to claim 2, wherein said blank exposure means further comprises a light source, and said reflecting member reflects both the light directly from said light source and the light reflected by said second reflecting member to said photosensitive member.

4. An apparatus according to claim 2, wherein said first reflecting member is movable, and said second reflecting member is fixed.

* * * * *

UNITED STATES PATENT AND TRADEMARK OFFICE

CERTIFICATE OF CORRECTION

PATENT NO. : 5,666,610

DATED : Sept. 9, 1997

INVENTOR(S) : TANAKA ET AL.

It is certified that error appears in the above-indentified patent and that said Letters Patent is hereby corrected as shown below:

Column 7

Line 7, "property" should read --properly--.

Column 9

Line 2, "i" should read --in--.

Signed and Sealed this

Twelfth Day of May, 1998

Bruce Lehman

*Attest:*

BRUCE LEHMAN

*Attesting Officer*

*Commissioner of Patents and Trademarks*